US007828594B2

(12) United States Patent
Burris et al.

(10) Patent No.: US 7,828,594 B2
(45) Date of Patent: Nov. 9, 2010

(54) COAXIAL CONNECTOR WITH TELESCOPING CENTER CONDUCTOR MECHANISM

(75) Inventors: Donald Andrew Burris, Peoria, AZ (US); Jan Michael Clausen, Vordingborg (DK)

(73) Assignee: Corning Gilbert Inc., Glendale, AZ (US)

( * ) Notice: Subject to any disclaimer, the term of this patent is extended or adjusted under 35 U.S.C. 154(b) by 78 days.

(21) Appl. No.: 12/261,533

(22) Filed: Oct. 30, 2008

(65) Prior Publication Data

US 2009/0111323 A1 Apr. 30, 2009

Related U.S. Application Data

(60) Provisional application No. 61/001,182, filed on Oct. 31, 2007.

(51) Int. Cl.
*H01R 9/05* (2006.01)

(52) U.S. Cl. ..... 439/578

(58) Field of Classification Search ..... 439/578, 439/584–585

See application file for complete search history.

(56) References Cited

U.S. PATENT DOCUMENTS

| | | | | |
|---|---|---|---|---|
| 4,813,887 | A * | 3/1989 | Capp | 439/580 |
| 5,141,451 | A | 8/1992 | Down | 439/585 |
| 5,975,951 | A | 11/1999 | Burris et al. | 439/585 |
| 5,997,350 | A | 12/1999 | Burris et al. | 439/585 |
| 6,790,081 | B2 | 9/2004 | Burris et al. | 439/578 |
| 6,935,892 | B2 * | 8/2005 | Holliday | 439/578 |
| 7,018,235 | B1 | 3/2006 | Burris et al. | 439/584 |
| 7,108,548 | B2 | 9/2006 | Burris et al. | 439/578 |
| 7,128,603 | B2 | 10/2006 | Burris et al. | 439/578 |
| 7,144,272 | B1 | 12/2006 | Burris et al. | 439/578 |
| 7,153,159 | B2 | 12/2006 | Burris et al. | 439/578 |
| 7,182,629 | B2 | 2/2007 | Zhang et al. | 439/495 |
| 7,182,639 | B2 | 2/2007 | Burris | 439/584 |
| 2004/0110418 | A1 * | 6/2004 | Holliday et al. | 439/585 |
| 2005/0272296 | A1 | 12/2005 | Laverick | 439/353 |
| 2007/0105439 | A1 | 5/2007 | Burris et al. | 439/578 |

FOREIGN PATENT DOCUMENTS

| | | |
|---|---|---|
| WO | WO2009/029210 | 3/2009 |

* cited by examiner

*Primary Examiner*—Edwin A. Leon
*Assistant Examiner*—Vanessa Girardi
(74) *Attorney, Agent, or Firm*—Matthew J. Mason

(57) ABSTRACT

A connector having a front end for attachment to a terminal and a back end for attachment to a coaxial cable includes a body, a post mounted within the body; and a contact assembly movably mounted within the post and body. The contact assembly includes a guide, a contact mounted to the guide, and preferably a clip mounted to the contact for making electrical and mechanical connection with the center conductor of the coaxial cable and a sabot. The contact assembly moves longitudinally toward the front end of the connector, such that the front end of the contact moves from a first position completely within the body to a second position proximate the connector interface, as the connector receives the coaxial cable. Preferably, the guide has an opening for the center conductor, which is viewable to a user during attachment until the center conductor enters the opening. The sabot moves with the contact assembly in a telescoping fashion enabling a greater distance of axial displacement. In addition, the contact assembly preferably contains a means to prevent the cable from being forced backward after installation.

17 Claims, 8 Drawing Sheets

COAXIAL CONNECTOR WITH TELESCOPING CENTER CONDUCTOR MECHANISM

CROSS-REFERENCE TO RELATED APPLICATIONS

This application claims the benefit of, and priority to U.S. Provisional Patent Application No. 61/001,182 filed on Oct. 31, 2007 entitled, "Coaxial Connector with Telescoping Center Conductor Mechanism", the content of which is relied upon and incorporated herein by reference in its entirety.

BACKGROUND OF THE INVENTION

1. Field of the Invention

This invention relates generally to coaxial cable connectors, and more particularly to coaxial cable connectors capable of being connected to a terminal.

2. Technical Background

Coaxial cable connectors, such as axially-compressible Type N connectors, are used to attach a coaxial cable to another object, such as an appliance or junction, having a terminal adapted to engage the connector. After an end of the coaxial cable is trimmed using one of several known cable preparation techniques, the trimmed end of the coaxial cable is inserted into a back end of the connector. Then, the connector is axially compressed using one of several known installation tools, and the connector and the coaxial cable become permanently attached to each other.

Disadvantageously, most known connectors require "blind entry" of the coaxial cable into the connector, meaning that a small opening in the connector into which it is necessary to insert the center conductor of the coaxial cable becomes blocked from a user's view by a dielectric or jacket of the coaxial cable. The dielectric or jacket blocks the user's view of the small opening primarily because the small opening is disadvantageously recessed too deeply in the connector. Such known connectors provide no means to ensure that the dielectric, or foam core, of the coaxial cable is properly centered within the connector during insertion of the coaxial cable into the connector.

During use, a contact of the connector is positioned near the front end of the connector. However, prior to use, there is no need for the contact to be positioned near the front end of the connector.

Many known connectors utilize separate or loose components that must be manipulated during installation, and, therefore, are subject to loss. For example, a known Type N connector is supplied with a loose pin, meaning that the pin is not integral with the body of the connector, when shipped. The loose pin is subject to loss. Extra manipulation such as crimping or soldering is required to install the separate component.

Another known coaxial connector uses the center conductor of the coaxial cable to push out the pin of the connector. Using the center conductor of the coaxial cable to push out the pin does not work well, if at all, when the center conductor is a small gauge wire.

Often times, said connectors are long in overall length due to application and design constraints and require a relatively long center contact arrangement.

SUMMARY OF THE INVENTION

A connector is disclosed herein for attachment to a coaxial cable. The coaxial cable comprises a center conductor and a dielectric layer surrounding the center conductor. The connector comprises: a longitudinal axis; a back end for receiving the coaxial cable; a front end; a body; a post fixedly mounted within the body; and a contact assembly movably mounted to the post, the contact assembly comprising a guide, a contact mounted to the guide, the contact having a front end and a back end, and preferably including a clip for making electrical and mechanical contact with the center conductor of the coaxial cable, the clip being fixedly mounted to a back end of the contact; wherein the contact assembly is capable of moving along the longitudinal axis toward the front end of the connector in response to insertion of the coaxial cable into the back end of the connector, wherein the front end of the contact extends within the connector body when the coaxial cable is fully inserted into the back end of the connector. The connector further comprises a sabot that moves with the contact assembly within the body preferably in a telescoping fashion enabling a greater distance of axial displacement. Preferably, a back side of the guide has an opening at the longitudinal axis for receiving the center conductor of the coaxial cable. In preferred embodiments, the back side of the guide is funnel-shaped to guide the center conductor of the coaxial cable toward the opening in the guide. Preferably, the dielectric layer of the coaxial cable moves the contact assembly. Preferably, the opening in the guide is viewable to a user during attachment until the center conductor of the coaxial cable enters the opening. In preferred embodiments, a back side of the guide is funnel-shaped with an opening at the longitudinal axis for receiving the center conductor of the coaxial cable, such that the dielectric layer, and not the center conductor, of the coaxial cable moves the contact assembly.

In one set of preferred embodiments, a connector is disclosed herein for attachment to a coaxial cable, wherein the coaxial cable comprises a center conductor and a dielectric layer surrounding the center conductor. The connector comprises a longitudinal axis; a back end for receiving the coaxial cable; a front end; a body; a post fixedly mounted within the body; and a contact assembly movably mounted within the post, the body, the post and the contact assembly having a common longitudinal axis, the contact assembly comprising a guide, a contact fixedly mounted to the guide, the contact having a front end and a back end, and preferably including a clip for making electrical and mechanical contact with the center conductor of the coaxial cable, the clip being fixedly mounted to a back end of the contact; wherein the contact assembly is capable of longitudinally moving toward the front end of the connector, such that the front end of the contact moves from a first position completely within the body to a second position, at least partially extending within the connector body in response to insertion of the coaxial cable into the back end of the connector. The connector further comprises a sabot that moves with the contact assembly within the body preferably in a telescoping fashion enabling a greater distance of axial displacement.

In another set of preferred embodiments, a connector is disclosed herein for attachment to a coaxial cable, wherein the coaxial cable comprises a center conductor and a dielectric layer surrounding the center conductor. The connector comprises a longitudinal axis; a back end for receiving the coaxial; a front end; a body; a post fixedly mounted within the body; and a contact assembly movably mounted within the post, the body, the post and the contact assembly having a common longitudinal axis, the contact assembly comprising a guide, a contact fixedly mounted to the guide, the contact having a front end and a back end, and preferably including a clip for making electrical and mechanical contact with the center conductor of the coaxial cable, the clip being fixedly mounted to a back end of the contact; wherein the contact assembly is capable of longitudinally moving toward the front end of the connector, such that the front end of the contact moves from a first position completely within the body to a second position, at least partially extending within the connector body in response to insertion of the coaxial cable into the back end of the connector.

The connector further comprises a sabot that moves with the contact assembly within the body preferably in a telescoping fashion enabling a greater distance of axial displacement. The said guide of the contact assembly provides a means to prevent appreciable backward movement of the contact assembly and cable core after the contact assembly and cable core have been moved fully forward within the connector.

In a preferred embodiment, the present invention can provide a coaxial connector that is more "installer friendly" and incorporates a positive visual indication that the connector is properly installed on a coaxial cable.

In a preferred embodiment, the present invention can provide a connector that has a contact that does not reside proximate the front end of the connector prior to use.

In a preferred embodiment, the present invention can provide a connector that provides a user with a view of an opening of the contact assembly into which the center conductor of a coaxial cable is to be inserted, while the coaxial cable is being inserted into the connector during attachment.

In a preferred embodiment, the present invention can provide a connector that uses the dielectric layer of the coaxial cable to move the contact of the connector.

In a preferred embodiment, the present invention can provide a connector with a relatively long center contact arrangement that can guide said contact arrangement.

In a preferred embodiment, the present invention can provide a connector that contains a simple and inexpensive means to prevent the assembled contact assembly and cable core from being forced appreciably backward by a load applied to the front end of the contact during mating with corresponding connectors.

Additional features and advantages of the invention will be set forth in the detailed description which follows, and in part will be readily apparent to those skilled in the art from that description or recognized by practicing the invention as described herein, including the detailed description which follows, the claims, as well as the appended drawings.

It is to be understood that both the foregoing general description and the following detailed description present embodiments of the invention, and are intended to provide an overview or framework for understanding the nature and character of the invention as it is claimed. The accompanying drawings are included to provide a further understanding of the invention, and are incorporated into and constitute a part of this specification. The drawings illustrate various embodiments of the invention, and together with the description serve to explain the principles and operations of the invention.

BRIEF DESCRIPTION OF THE DRAWINGS

The present invention will be described with greater specificity and clarity with reference to the following drawings, in which.

Figure 1:
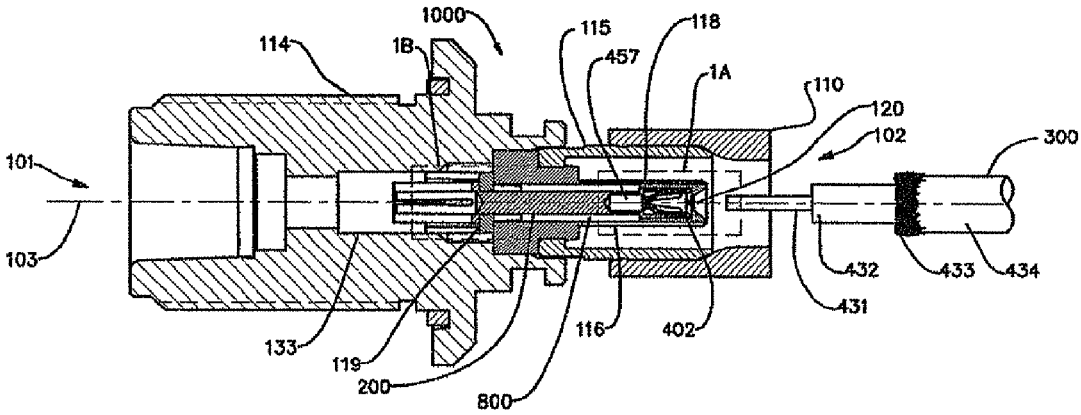
FIG. 1 is a partial cross-sectional view of a Type N connector 1000 and a side view of a coaxial cable, prior to attachment, including a contact assembly, a post and a sabot, the connector having a front end female contact.

For simplicity and clarity of illustration, the drawing figures illustrate the general manner of construction, and descriptions and details of well-known features and techniques are omitted to avoid unnecessarily obscuring the invention. Furthermore, elements in the drawing figures are not necessarily drawn to scale.

DETAILED DESCRIPTION OF THE PREFERRED EMBODIMENTS

Additional features and advantages of the invention will be set forth in the detailed description which follows and will be apparent to those skilled in the art from the description or recognized by practicing the invention as described in the following description together with the claims and appended drawings.

As used herein, the term "contact assembly" refers to an assembly that is longitudinally movable within a connector and contacts a center conductor of a coaxial cable at one end and has a male or female contact at the other end, wherein the male or female contact can be used to interface or mate with corresponding connectors. In at least one preferred embodiment, the contact assembly includes a guide at one end for electrically and mechanically contacting the center conductor of a coaxial cable. The guide is preferably a female component into which the center conductor of the coaxial cable is inserted, thereby establishing electrical and mechanical contact between the center conductor of the cable and the contact.

As used herein, the term "sabot" refers to a component that is longitudinally movable within a connector and circumferentially surrounds at least a portion of the contact assembly and helps to guide and center the contact assembly within the body of the connector. In at least one preferred embodiment, the sabot is capable of slidably engaging at least a portion of the outer diameter of the contact assembly while slidably engaging at least a portion of an inner diameter of a bore longitudinally extending within at least a portion of the connector. In at least one preferred embodiment, the sabot includes a front portion, a middle portion, and a rear portion, wherein the front portion has a plurality of axial slits forming a plurality of segments and the rear portion of the sabot has a plurality of axial slits forming a plurality of segments.

FIG. 1 is a partial cross-sectional view of an axially-compressible Type N connector 1000 and a side view of the cable 300, prior to attachment together in accordance with a preferred embodiment of the present invention.

FIG. 1 shows a first embodiment of Type N connector 1000 as it preferably appears prior to use, such as during transport, or shipment, and during storage, hereinafter an "as shipped" state. Type N connector 1000 is generally tubular, and has a front end 101, a back end 102, and a central longitudinal axis 103. Front end 101 is for removable attachment to a terminal (not shown). Back end 102 is for attachment to coaxial cable 300. Type N connector 1000 comprises a compression ring 110 that is generally tubular shaped. Preferably, compression ring 110 is made of metallic material. Compression ring 110 is mounted onto a deformable body 115, preferably by a press-fit. Preferably, deformable body 115 is made of plastic material. Deformable body 115 is attached to a generally tubular shaped post 116 preferably by means of a snap fit. Preferably, post 116 is made of metallic material. Post 116 is attached to a connector body 114, preferably by a press-fit. Preferably connector body 114 is made of metallic material. A generally tubular shaped guide 118 is mounted within post 116. Preferably, guide 118 is made of dielectric material. Contact assembly 800 comprises guide 118, contact 200, and spring clip or clip 402. Preferably contact 200 is metallic as is clip 402. Sabot 119 is preferably slidably engaged with connector body 114, post 116 and contact assembly 800. Preferably, sabot 119 is made of dielectric material. Compression ring 110, connector body 114, deformable body 115, post 116 and guide 118, contact assembly 800 and sabot 119 preferably share the same longitudinal axis 103. A small opening in guide 118 near back end 102 of Type N connector 1000 at longitudinal axis 103 forms a target area 120 that is advantageously near back end 102 of Type N connector 1000. Advantageously, contact 200 is not proximate front end 101 of Type N connector 1000 when in the "as shipped" state. As a result, connector body 114 of connector 1000 protects contact 200 from damage during shipment. Cable 300 comprises a center conductor 431, surrounded by a dielectric layer 432, which may be a foam core, surrounded by an outer conductor 433 (shown in FIG. 1 as being wrapped back), surrounded by a jacket 434.

Figure 2:
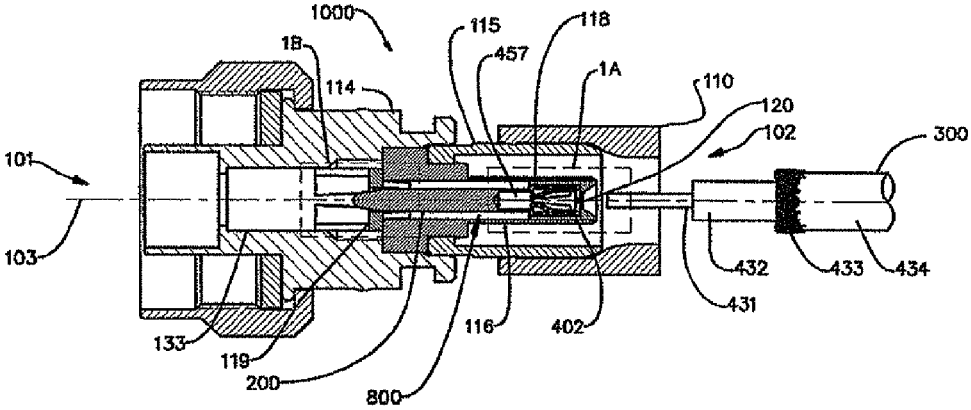
FIG. 2 is a partial cross-sectional view of a Type N connector 1000 and a side view of a coaxial cable, prior to attachment, including a contact assembly, a post and a sabot, the connector having a front end male contact.

FIG. 2 shows an analogous Type N connector 1000 as that shown in FIG. 1, except instead of having a front end female contact, the connector has a front end male contact.

Figure 3:
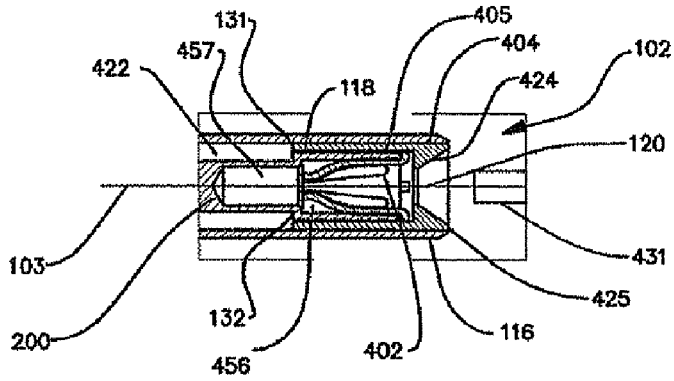
FIG. 3 is an enlargement of area 1A of FIG. 1 or FIG. 2.

FIG. 3 is an enlargement of Area 1A of FIG. 1 or FIG. 2 showing guide 118 prior to insertion of center conductor 431 of cable 300. Post 116 has an inner surface defining a cylindrical bore 422 along longitudinal axis 103 of the post. Bore 422 extends the length of post 116. Guide 118 is mounted within the bore 422 of the post 116. Guide 118 includes an outer diameter 404 and an inner bore 405. A rear portion of guide 118 preferably includes an angled surface 424, forming a funnel, which aids in the insertion of the center conductor 431 of the cable 300 into the target area 120. In preferred embodiments, guide 118 is machined or molded from a plastic material such as acetal. Locating guide 118 and contact 200 near the back end 102 of Type N connector 1000 reduces blind entry of the cable 300. The circumferential relationship between guide 118 and the bore 422 in the post 116 ensures that the guide engages the inner surface of the post 116 and keeps contact 200 centered in bore 422 of the post along longitudinal axis 103. Outer diameter 404 of the guide 118 bears against bore 422 of post 116 with enough force to maintain position in the as shipped state but not with so much force that it can not be dislodged by dielectric layer 432 during installation.

Figure 3A:
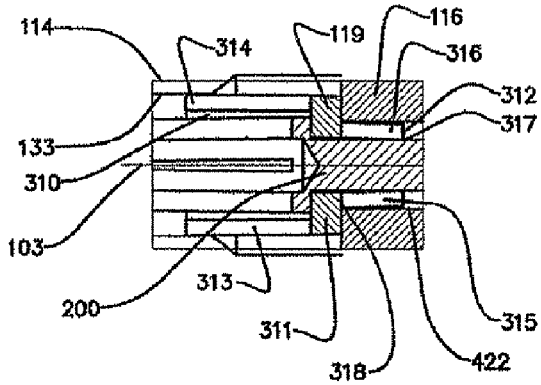
FIG. 3A is an enlargement of area 1B of FIG. 1.

FIG. 3A is an enlargement of Area 1B of FIG. 1 showing the relationship of sabot 119 with front end of contact 200 prior to insertion of center conductor 431 of cable 300. Connector body 114 has an inner surface defining body bore 133 along longitudinal axis 103. Sabot 119 is mounted within bore 133 of the connector body 114. Sabot 119 includes a front portion 310 a middle portion 311 and a rear portion 312. Front portion 310 of sabot 119 has a plurality of axial slits forming a plurality of segments. In one preferred embodiment, front portion 310 has two (2) axial slits, thereby forming four (4) segments. Segments 313 and 314 of sabot 119 are visible in FIG. 3A. Rear portion 312 of sabot 119 has a plurality of axial slits forming a plurality of segments. In one preferred embodiment, rear portion 312 has one (1) axial slit, thereby forming two (2) segments. Segments 315 and 316 are visible in FIG. 3A. The outside of the front portion segments (313 and 314 shown) are circumferentially outwardly disposed and slidably or frictionally engage bore 113. The inside surfaces illustrated by 317 of the rear portion 312 of sabot 119 are circumferentially inwardly disposed and slidably or frictionally engage the outside diameter of contact 200. Portion 318 of sabot 119 joining segments 315 and 316 with middle portion 311 slidably or frictionally engages post bore 422 when the connector is in the as shipped condition.

The frictional engagements described above causes contact assembly 800, guide 118 and sabot 119 to remain in place in the as shipped condition and allows contact assembly 800, guide 118 and sabot 119 to move forward within connector 1000 relative to post 116 and connector body 114 when a sufficient axial force in a forward direction is applied by dielectric layer 432. Guide 118 further comprises front annular face 131 and rear face 425. The contact 200 further comprises annular shoulder 132.

Figure 3B:
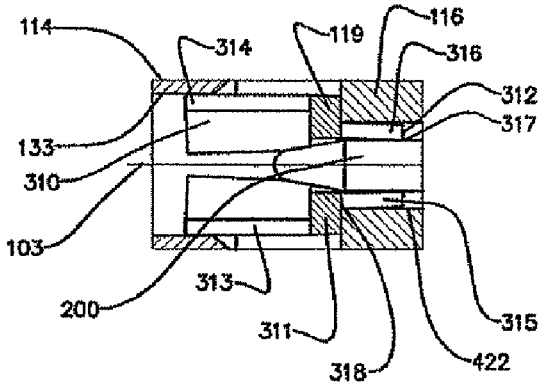
FIG. 3B is an enlargement of area 1B of FIG. 2.

FIG. 3B is an analogous enlargement of Area 1B of FIG. 2, wherein instead of having a front end female contact, the connector has a front end male contact.

Figure 4:
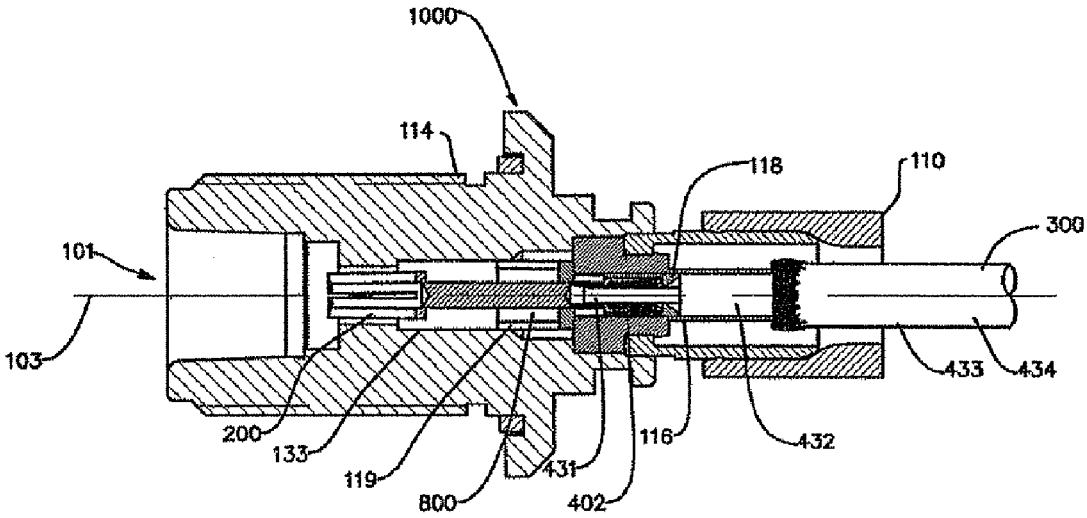
FIG. 4 is a partial cross-sectional view of the Type N connector of FIG. 1 and a side view of the coaxial cable, at a first stage of attachment.

FIG. 4 is a partial cross-sectional view of connector 1000 illustrated in FIG. 1 and a side view of cable 300, at a first stage of attachment showing cable 300 partially inserted. A tip of center conductor 431 of cable 300 has entered clip 402 of contact assembly 800. A standard cable preparation tool exposes center conductor 431 of cable 300 a shorter amount than distance 502. As a result, dielectric layer 432 of cable 300, and not center conductor 431 of cable 300, pushes contact assembly 800 forward within connector body 114 and post 116. In FIG. 4, contact assembly 800 and guide 118 have been moved forward an intermediate distance as a result of dielectric layer 432 pushing against guide 118.

Figure 5:
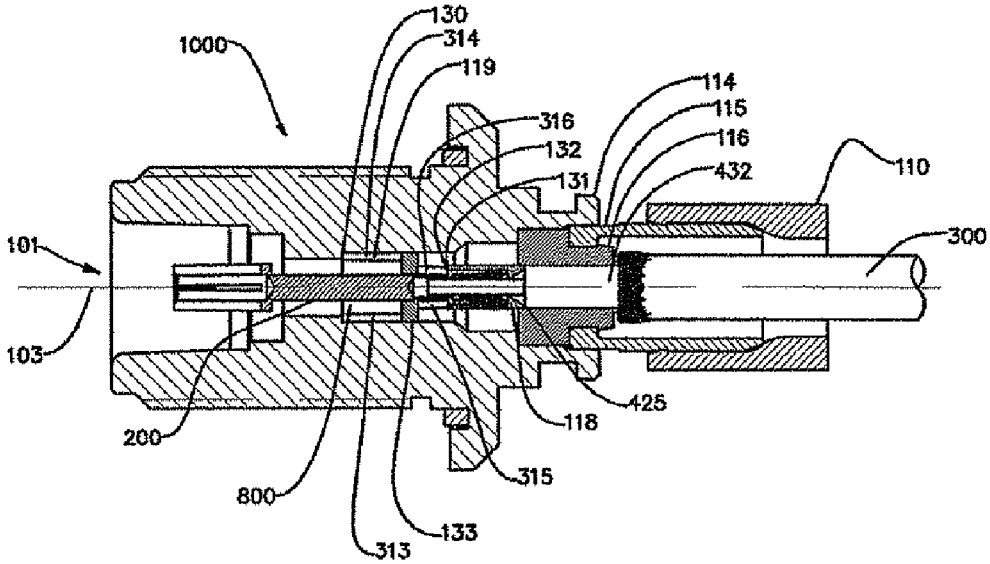
FIG. 5 is a partial cross-sectional view of the Type N connector of FIG. 1 and a side view of the coaxial cable, at a second stage of attachment.

FIG. 5 is a partial cross-sectional view of connector 1000 illustrated in FIG. 1 and a side view of cable 300, showing a second stage of attachment in which cable 300 fully seated within connector 1000. In FIG. 5, contact 200 is in a final position, that is, it has been moved fully forward within the connector as a result of the relationship of sabot 119 with other components of the connector. Sabot 119, which provides a means to guide and center contact assembly 800 within connector body 114, has been moved fully forward, as a result of being driven by guide 118, which in turn has been driven by dielectric layer 432. When contact 200 and sabot 119 are moved fully forward, segments 313 and 314 of front portion 310 of sabot 119 abut annular shoulder 130 and bore 133 of connector body 114 while segments 315 and 316 of rear portion 312 of sabot 119 simultaneously abut annular shoulder 132 of contact 200, the outside diameter of contact 200 and annular face 131 of guide 118 while rear face 425 of guide 118 simultaneously abuts dielectric layer 432. Thus compiled, these components create a firm tactile stop, or positive stop to the forward motion of cable 300. As shown in FIG. 5, an advantage of connector 1000 is that proper seating of cable 300 is indicated by the final position of contact 200, which, when pushed toward the front end of the connector, visibly extends from within front end 101 and thus can provide visual confirmation of proper insertion of cable 300.

Figure 6:
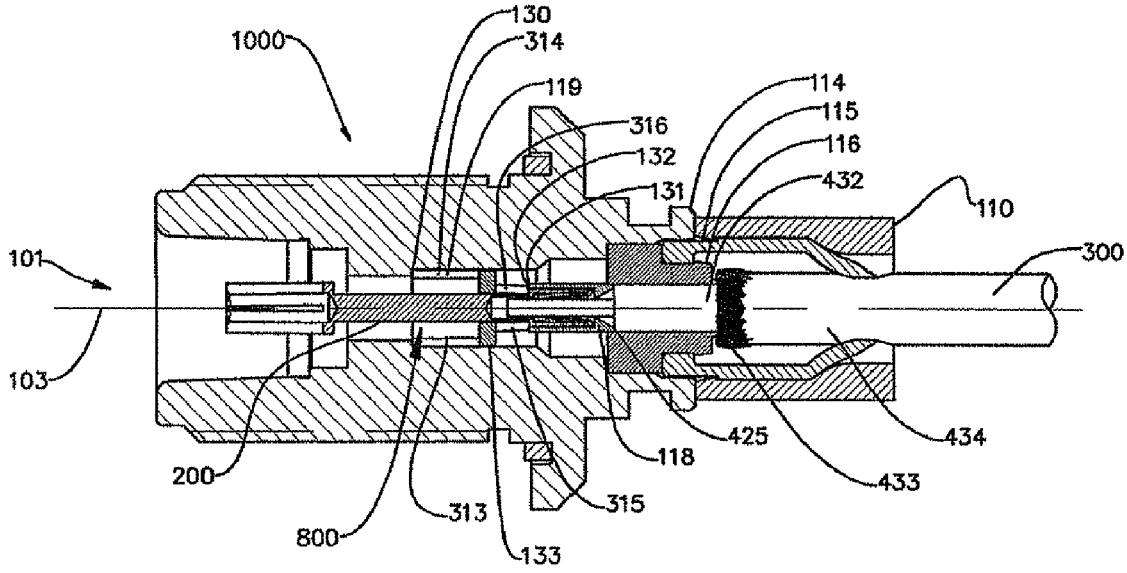
FIG. 6 is a partial cross-sectional view of the Type N connector of FIG. 1 and a side view of the coaxial cable, fully assembled together.

FIG. 6 is a partial cross-sectional view of connector 1000 and cable 300, assembled together, with contact 200 remaining in the fully pushed up position. FIG. 6 shows compression ring 110, moved into a closed position, which drives deformable body 115 to sandwich outer conductor 433 and jacket 434 of cable 300 with post 116. Additional description relevant to this configuration for securing the cable within the compression ring is set forth, for example, in U.S. Pat. No. 5,975,951, the entire disclosure of which is hereby incorporated by reference in its entirety. In FIG. 6, connector 1000 is shown in an "in use" state wherein contact 200 has been moved fully forward and sabot 119, contact assembly 800, guide 118 and dielectric layer 432 are compiled are as described with reference to FIG. 5.

Figure 7:
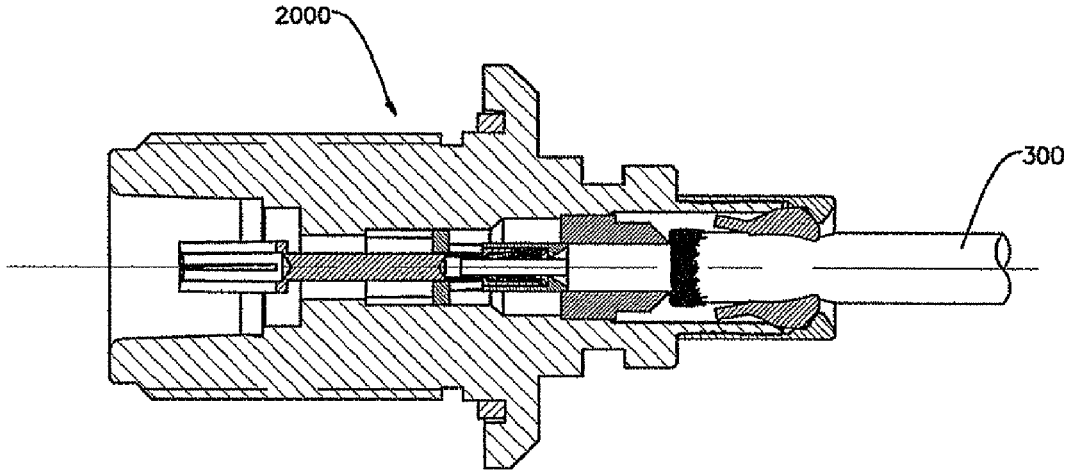
FIG. 7 is a partial cross-sectional view of the Type N connector 2000 and a side view of the coaxial cable, fully assembled together, the connector having a front end female contact.

FIG. 7 is a partial cross-sectional view of a Type N connector 2000, and a side view of a coaxial cable fully assembled together, including a contact assembly, a post and a sabot. FIG. 7 embodies the concepts described above and offers an alternative embodiment for securing the cable within the compression ring. Additional description relevant to the configuration shown in FIG. 7 for securing the cable within the compression ring is set forth, for example, in U.S. Pat. Nos. 7,018,235 and 7,182,629, the entire disclosures of which are hereby incorporated by reference in their entirety. While FIG. 7 shows a connector with a front end female contact, connectors having a front end male contact are also within the scope of this embodiment.

Figure 8:
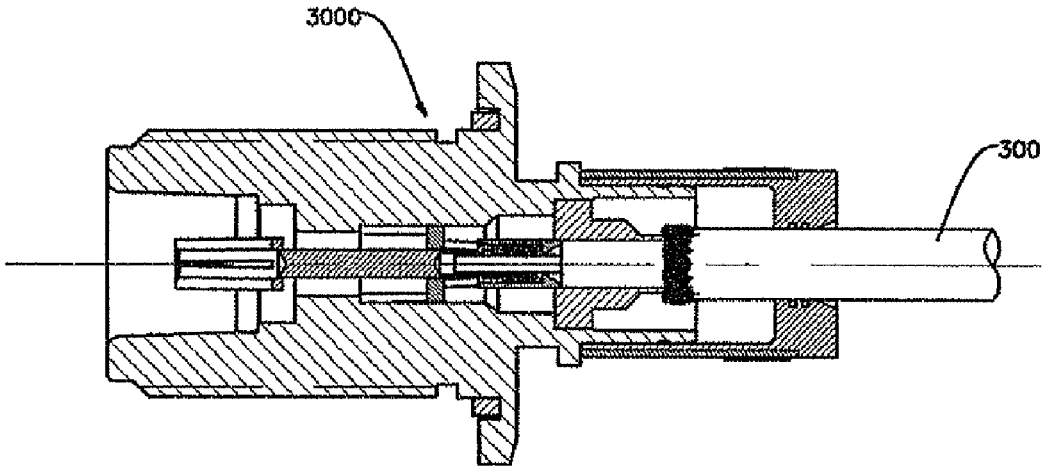
FIG. 8 is a partial cross-sectional view of the Type N connector 3000 and a side view of the coaxial cable, fully assembled together, the connector having a front end female contact.

FIG. 8 is a partial cross-sectional view of a Type N connector 3000, and a side view of a coaxial cable fully assembled together, including a contact assembly, a post and a sabot. FIG. 8 embodies the concepts described above and offers an alternative embodiment for securing the cable. Additional description relevant to the configuration shown in FIG. 8 for securing the cable is set forth, for example, in U.S. Pat. Nos. 6,790,081, 7,108,548, 7,128,603, 7,144,272, and 7,153,159, the entire disclosures of which are hereby incorporated by reference in their entirety. While FIG. 8 shows a connector with a front end female contact, connectors having a front end male contact are also within the scope of this embodiment.

Figure 9:
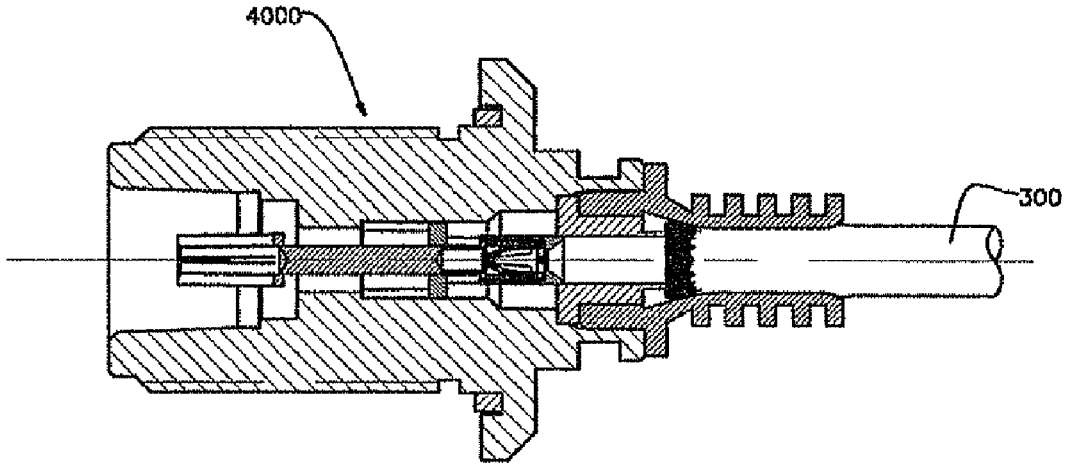
FIG. 9 is a partial cross-sectional view of the Type N connector 4000 and a side view of the coaxial cable, fully assembled together, the connector having a front end female contact.

FIG. 9 is a partial cross-sectional view of a Type N connector 4000, and a side view of a coaxial cable fully assembled together, including a contact assembly, a post and a sabot. FIG. 9 embodies the concepts described above and offers an alternative embodiment for securing the cable. Additional description relevant to the configuration shown in FIG. 9 for securing the cable is set forth, for example, in U.S. Pat. No. 5,141,451, the entire disclosure of which is hereby incorporated by reference in its entirety. While FIG. 9 shows a connector with a front end female contact, connectors having a front end male contact are also within the scope of this embodiment.

Figure 10:
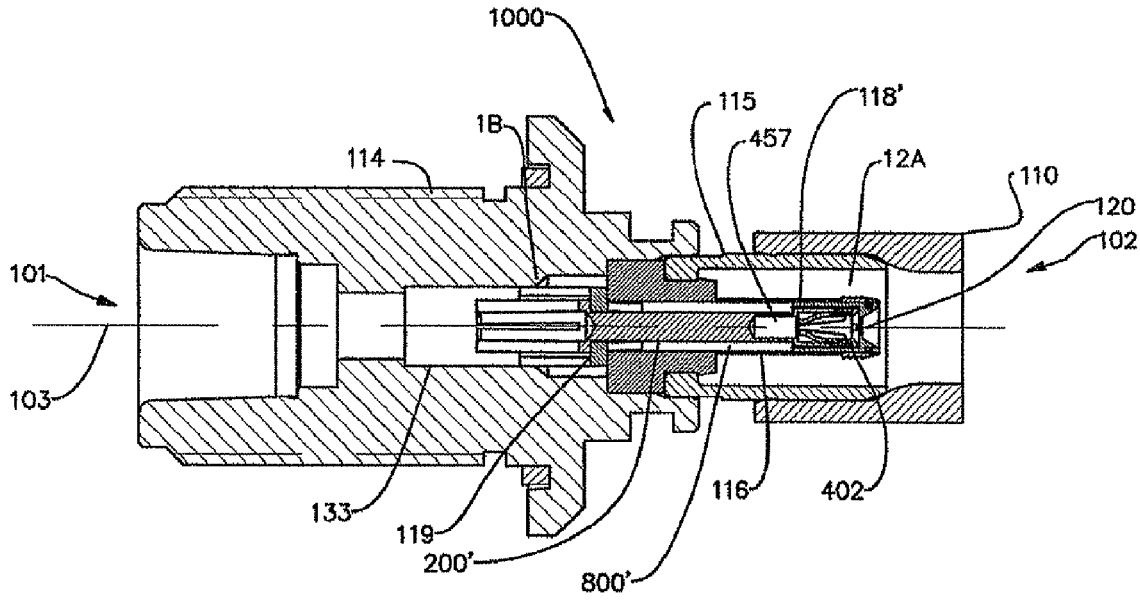
FIG. 10 is a partial cross-sectional view of the Type N connector 1000, prior to attachment to a coaxial cable, including a contact assembly, a post, a sabot and a free floating ring, the connector having a front end female contact.

FIG. 10 is a partial cross-sectional view of an axially-compressible Type N connector 1000 and a side view of cable 300, prior to attachment together in accordance with an alternative embodiment of the present invention. FIG. 10 shows Type N connector 1000 as it preferably appears prior to use, such as during transport, or shipment, and during storage, hereinafter an "as shipped" state. FIG. 10 is a partial cross-sectional view of the present invention with an alternative embodiment of contact 200' comprising barbs to engage it to guide 118. While FIG. 10 shows a connector with a front end female contact, connectors having a front end male contact are also within the scope of this embodiment.

Figure 10A:
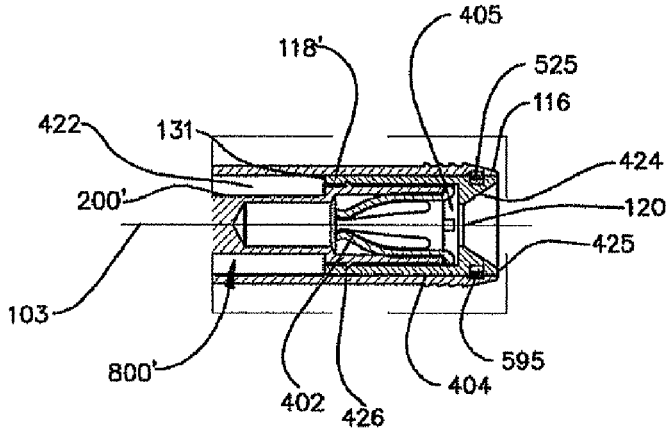
FIG. 10A is an enlargement of area 12A of FIG. 10.

FIG. 10A is an enlargement of Area 12A of FIG. 10. Post 116 has an inner surface defining a cylindrical bore 422 along longitudinal axis 103 of post 116. Bore 422 extends the length of post 116. Guide 118' is mounted within bore 422 of post 116. Guide 118' includes an outer diameter 404 and inner bore 405. A rear portion of guide 118' preferably includes an angled surface 424, forming a funnel, which aids in the insertion of center conductor 431 of cable 300 into the target area 120. In preferred embodiments, guide 118' is machined or molded from a plastic material such as acetal. The location of guide 118' and contact 200' being near the back end 102 of Type N connector 5000 reduces blind entry of cable 300. The circumferential relationship between guide 118' and bore 422 in post 116 ensures that the guide engages the inner surface of post 116 and keeps contact 200 centered in bore 422 of the post. In preferred embodiments, guide 118' is engaged by contact 200 by means of a metallic barb 426 in the contact. Metallic barb 426 preferably embeds itself in the relatively pliable guide 118' thereby comprising contact assembly 800'. Said guide 118' of contact assembly 800' provides a means to prevent appreciable backward movement of the contact assembly and cable core after the contact assembly and cable core have been moved fully forward within the connector. Encircling guide 118' about groove 595 in rear portion of the guide is a free floating ring 525. Preferably free floating ring 525 is made of electrically insulative material. Free floating ring 525 is kept in a coaxial relationship by bore 422 of post 116.

Figure 11:
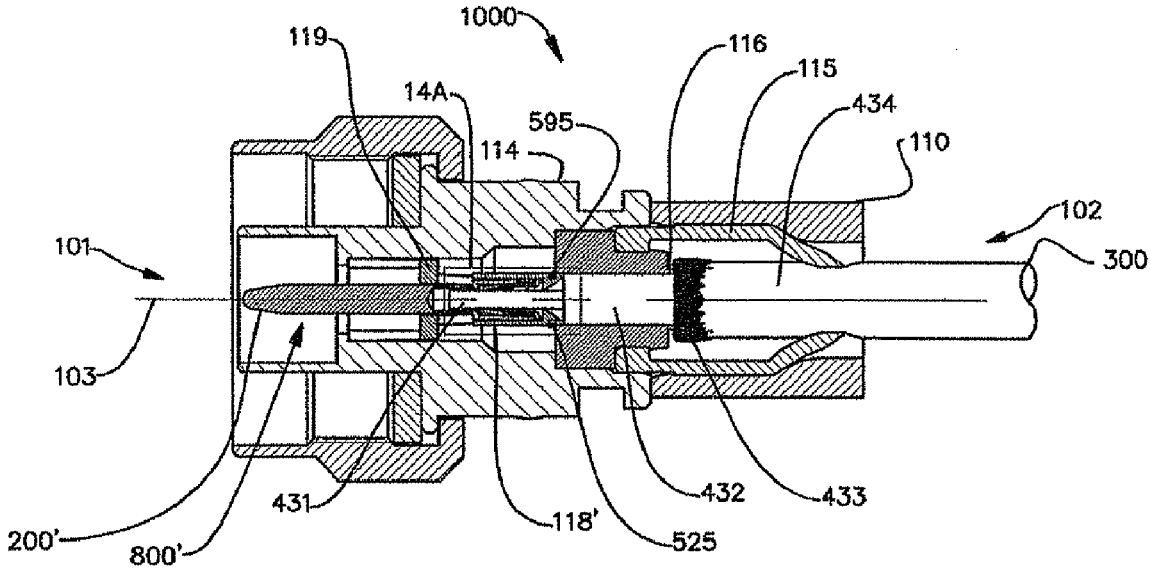
FIG. 11 is a partial cross-sectional view of the Type N connector 1000 and a side view of the coaxial cable, fully assembled together, the connector having a front end male contact.

FIG. 11 is a partial cross-sectional view of connector 1000 of FIG. 10 and a side view of cable 300, assembled together, with contact 200' remaining in the fully pushed up position, where instead of having a front end female contact, the connector has a front end male contact. FIG. 11 shows compression ring 110, moved into a closed position, which drives deformable body 115 to sandwich outer conductor 433 and jacket 434 of cable 300 with post 116. In FIG. 11, contact 200' is in a final position, wherein it has been moved fully forward within the connector as a result of the relationship of sabot 119 with other components of the connector as described above with reference to FIG. 5. In FIG. 11 free floating ring 525 drops off-axis within annular groove 595 of rear portion of guide 118'.

Figure 12A:
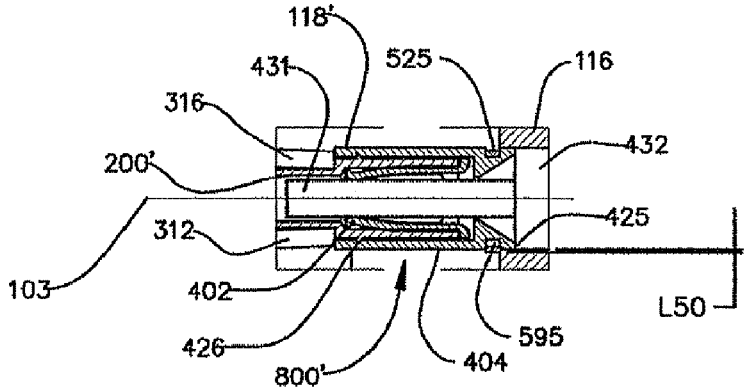
FIG. 12A is an enlargement of area 14A of FIG. 11.

FIG. 12A is an enlargement of area 14A of FIG. 11. In FIG. 12A free floating ring 525 drops off-axis within annular groove 595 of rear portion of guide 118' and a portion of free floating ring 525 extends beyond outer surface of guide 118' as indicated by L50. The portion of free floating ring 525 expressed by L50 acts as a rearward stop when force is applied to the connector interface pin during mating with corresponding connectors.

Figure 12B:
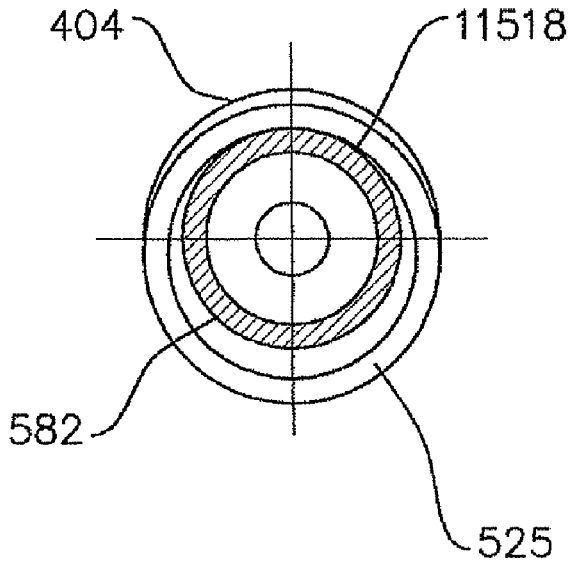
FIG. 12B in an enlarged partial cross-sectional end view of the mechanism illustrated in FIG. 12A.

FIG. 12B is an enlarged partial cross-sectional end view of the mechanism illustrated in FIG. 12A illustrating the circumferential relationship of the inside diameter of free floating ring 525 and outside diameter 582 of guide 118'. Further illustrated is slit 11518 that aids with the installation of free floating ring 525 over outer diameter 404 of guide 118' and into annular groove 595.

Figure 12C:
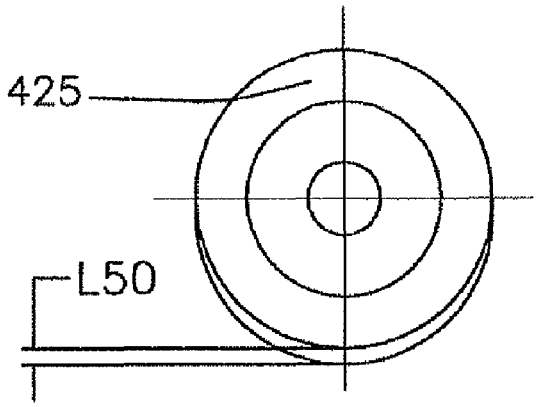
FIG. 12C in an enlarged perspective view (opposite end from FIG. 12B) of the mechanism illustrated in FIG. 12A.

FIG. 12C is an enlarged perspective view (opposite end from FIG. 12B) of the mechanism illustrated in FIG. 12A illustrating exposed portion L50 of free floating ring 525 in relationship to outside diameter 404 of guide 118'.

While the present invention has been described with respect to preferred embodiments thereof, such description is for illustrative purposes only, and is not to be construed as limiting the scope of the invention. Various modifications and changes may be made to the described embodiments by those skilled in the art without departing from the true spirit and scope of the invention as defined by the appended claims.

For example, while the above embodiments were described with reference to Type N connectors, the present invention is not so limited. In particular, alternative embodiments of Type N connectors are also contemplated as being within the scope of the invention. In addition, the invention may be applied to almost any manner of coaxial connector, including Type F and BNC.

It will be apparent to those skilled in the art that various modifications and variations can be made to the present invention without departing from the spirit and scope of the invention. Thus it is intended that the present invention cover the modifications and variations of this invention provided they come within the scope of the appended claims and their equivalents.

What is claimed is:

1. A connector for attachment to a coaxial cable, the coaxial cable comprising a center conductor and a dielectric layer surrounding the center conductor, the connector comprising:

a longitudinal axis;

a back end for receiving the coaxial cable;

a front end;

a body; and a contact assembly movably mounted within the connector, the contact assembly comprising:

a guide; and a contact mounted to the guide for making electrical and mechanical contact with the center conductor of the coaxial cable, the contact having a front end and a back end;

wherein the contact assembly is capable of moving along the longitudinal axis toward the front end of the connector in response to insertion of the coaxial cable into the back end of the connector, wherein the front end of the contact extends within the connector body when the coaxial cable is fully inserted into the back end of the connector;

wherein the electrical connector further comprises a sabot that is capable of moving with the contact assembly within the body, the sabot having a front portion and a back portion; and wherein the connector comprises a post, wherein the post comprises a bore and the sabot is capable of slidably engaging the bore of the post.

2. The connector of claim 1, wherein the front end of the contact visibly extends within the connector body when the coaxial cable is fully inserted into the back end of the connector.

3. The connector of claim 1, wherein the dielectric layer of the coaxial cable moves the contact assembly when the center conductor of the coaxial cable is inserted into the guide.

4. The connector of claim 1, wherein the guide has an opening that is viewable to a user during attachment until the center conductor of the coaxial cable enters the opening.

5. The connector of claim 1, wherein a back side of the guide is funnel-shaped with an opening at the longitudinal axis for receiving the center conductor of the coaxial cable, such that the dielectric layer, and not the center conductor, of the coaxial cable moves the contact assembly when the center conductor of the coaxial cable is fully inserted into the guide.

6. The connector of claim 1, wherein the front end of the contact comprises a female contact.

7. The connector of claim 1, wherein the front end of the contact comprises a male contact.

8. The connector of claim 1, wherein a back side of the guide has an opening at the longitudinal axis for receiving the center conductor of the coaxial cable.

9. The connector of claim 8, wherein the back side of the guide is funnel-shaped to guide the center conductor of the coaxial cable toward the opening in the guide.

10. The connector of claim 1, wherein the body comprises a bore extending towards an annular shoulder, wherein the front portion of the sabot abuts the annular shoulder when the coaxial cable is fully inserted into the back end of the connector.

11. The connector of claim 10, wherein the contact comprises an annular shoulder, wherein the back portion of the sabot abuts the annular shoulder of the contact.

12. The connector of claim 10, wherein the guide comprises an annular face and a rear face and the sabot abuts the annular face of the guide and the rear face of the guide abuts the dielectric layer.

13. A method of inserting a coaxial cable into a connector, the connector comprising a front end, a back end and a longitudinal axis, and the coaxial cable comprising a center conductor and a dielectric layer surrounding the center conductor, the method comprising:

inserting the center conductor into a guide of a contact assembly, wherein the contact assembly is movably mounted to the connector; and causing the contact assembly to longitudinally move toward the front end of the connector, causing a sabot to move with the contact assembly, the sabot having a front portion and a back portion, and causing the front end of the contact to extend within the front end of the connector by pushing the coaxial cable into the back end of the connector; and wherein the connector comprises a body comprising a bore extending towards an annular shoulder, wherein the front portion of the sabot abuts the annular shoulder when the coaxial cable is fully inserted into the back end of the connector.

14. The method of claim 13, wherein the connector comprises a body and a post fixedly mounted within the body; wherein the contact assembly is movably mounted to the post.

15. The method of claim 13, wherein a back side of the guide is funnel-shaped with an opening at the longitudinal axis for receiving the center conductor of the coaxial cable, such that the dielectric layer, and not the center conductor, of the coaxial cable moves the contact assembly when the center conductor of the coaxial cable is inserted into the guide.

16. The method of claim 13, wherein the front end of the contact is caused to visibly extend from within the front end of the connector.

17. The method of claim 13, wherein the contact comprises an annular shoulder and the sabot does not move longitudinally with the contact assembly until the annular shoulder of the contact abuts back portion of the sabot.

* * * * *